US008162321B1

(12) United States Patent
Shank, Jr.

(10) Patent No.: US 8,162,321 B1
(45) Date of Patent: Apr. 24, 2012

(54) BULLET TRAP

(76) Inventor: John Mohr Shank, Jr., Winter Oaks, FL (US)

( * ) Notice: Subject to any disclaimer, the term of this patent is extended or adjusted under 35 U.S.C. 154(b) by 0 days.

(21) Appl. No.: 13/184,812

(22) Filed: Jul. 18, 2011

(51) Int. Cl.
*F41J 13/00* (2009.01)

(52) U.S. Cl. ..... 273/410

(58) Field of Classification Search ..... 273/403–410
See application file for complete search history.

(56) References Cited

U.S. PATENT DOCUMENTS 1,992,001 A * 2/1935 Caswell ..... 273/410
2,772,092 A 11/1956 Nikoden
3,737,165 A 6/1973 Pencyla
4,201,385 A * 5/1980 Szabados ..... 273/410
4,512,585 A 4/1985 Baravaglio
4,786,059 A 11/1988 Barini
5,070,763 A 12/1991 Coburn
5,718,434 A 2/1998 Alward
5,749,177 A * 5/1998 Pontus et al. ..... 52/79.1
6,588,759 B1 * 7/2003 Bateman ..... 273/407
7,434,811 B1 10/2008 Coburn et al.
2009/0102130 A1 * 4/2009 Bavaro et al. ..... 273/410

* cited by examiner

*Primary Examiner* — Mark Graham
(74) *Attorney, Agent, or Firm* — Lambert & Associats; Gary E. Lambert; David J. Connaughton, Jr.

(57) ABSTRACT

A bullet trap is provided having a housing, a plurality of downward sloping ramps, and a bullet receptacle. The bullet trap may provide a low cost, easy to maintain and effective bullet trap solution for firing ranges.

20 Claims, 4 Drawing Sheets

BULLET TRAP

BACKGROUND OF THE INVENTION

1. Field of the Invention

The present invention relates generally to bullet traps. More particularly, the present invention relates to a bullet trap that retains a substantial portion of a bullet trapped by the bullet trap.

2. Description of Related Art

Bullet traps per se are well-known and have been used for many years. Typically, such traps are used by firearm manufacturers, by training facilities for military or police personnel, and by recreational target shooting facilities. Bullet traps are of widely varying configurations, from wood boards, to sand-filled traps, to complex deceleration chambers.

By way of example, a known sand-type bullet trap typically consists of a quantity of sand in a hardwood box set against a concrete wall. This type of trap poses several problems. As the trap begins to fill with lead bullets, there is a risk that an incoming bullet will strike a bullet lodged in the sand and ricochet in a dangerous manner. Therefore, the sand must be changed periodically, requiring extensive labor at considerable cost. Mechanical bullet traps having deflecting plates or deceleration chamber designs are also in existence.

To this point, existing mechanical bullet traps have proved inadequate at solving the problem of safely minimizing lead contamination to the environment with an economical, easily maintained device. For example, deflecting plate/deceleration chamber designs have employed large quantities of expensive high strength steel necessitated by the high bullet impact angles employed in the designs. In addition, the construction of deceleration chambers is complex and therefore expensive to build. Known deceleration chambers also suffer from the fact that their designs make inspection and replacement of parts difficult or impossible without a complete disassembly of the bullet trap. Moreover, many of the known bullet traps fail to provide any means for preventing the release of lead particles and dust into the atmosphere because they cause a substantial break down of bullets fired into them.

Other bullet trap systems may further include fluid spraying and flow systems that act to lubricate the trap, slow the bullet and catch bullet fragments. However, these systems require complex fluid flow and piping systems which adds to their cost, and maintenance needs.

Therefore, what is needed is a low cost, easy to maintain modular bullet trap that minimizes the release of lead dust and maintains a substantial portion of the bullet.

SUMMARY OF THE INVENTION

The subject matter of this application may involve, in some cases, interrelated products, alternative solutions to a particular problem, and/or a plurality of different uses of a single system or article.

In one aspect, one embodiment of a bullet trap is provided. The bullet trap comprises a housing having a bottom, a rear wall and two side walls a ramp extending substantially horizontally between the two side walls, the ramp being angled downward towards the rear wall of the housing, and constructed and arranged to receive a bullet fired from a firearm, wherein the ramp has a sharpened leading edge, a substantially flat center portion, and a downward arcing portion at a rear of the ramp, an arced section formed in the housing along an intersection of the rear wall and the bottom of the housing, and a bullet receptacle at the bottom of the housing, positioned in front of the arced section.

In another aspect, a bullet trap for securing bullets and minimizing lead dust is provided. The bullet trap comprising a housing having a bottom, a rear wall and two side walls, a plurality of ramps extending substantially horizontally between the two side walls, the plurality of ramps are constructed and arranged to receive a bullet fired from a firearm, wherein the plurality of ramps are angled downward towards the rear wall of the housing at an angle substantially between 17-20 degrees to allow a smooth travel of the bullet along the plurality of ramps, an arced section formed in the housing along an intersection of the rear wall and the bottom of the housing, and a bullet receptacle at the bottom of the housing, positioned in front of the arced section, constructed and arranged to secure the bullet fired from the firearm.

In yet another aspect, a bullet trap for securing bullets and minimizing lead dust by maintaining at least 98% of a bullet fired into the bullet trap. The bullet trap comprising a housing having a bottom, a rear wall and two side walls, a plurality of ramps extending substantially horizontally between the two side walls, the plurality of ramps constructed and arranged to receive a bullet fired from a firearm, wherein the plurality of ramps are angled downward towards the rear wall of the housing at an angle substantially between 17-20 degrees to allow a smooth travel of the bullet along the plurality of ramps and preventing a breakdown of the bullet, an arced section formed in the housing along an intersection of the rear wall and the bottom of the housing; a bullet receptacle at the bottom of the housing, positioned in front of the arced section, constructed and arranged to secure at least 98% of the bullet fired from the firearm, and a quantity of bullet receiving material positioned within the bullet receptacle.

DETAILED DESCRIPTION

Figure 1:
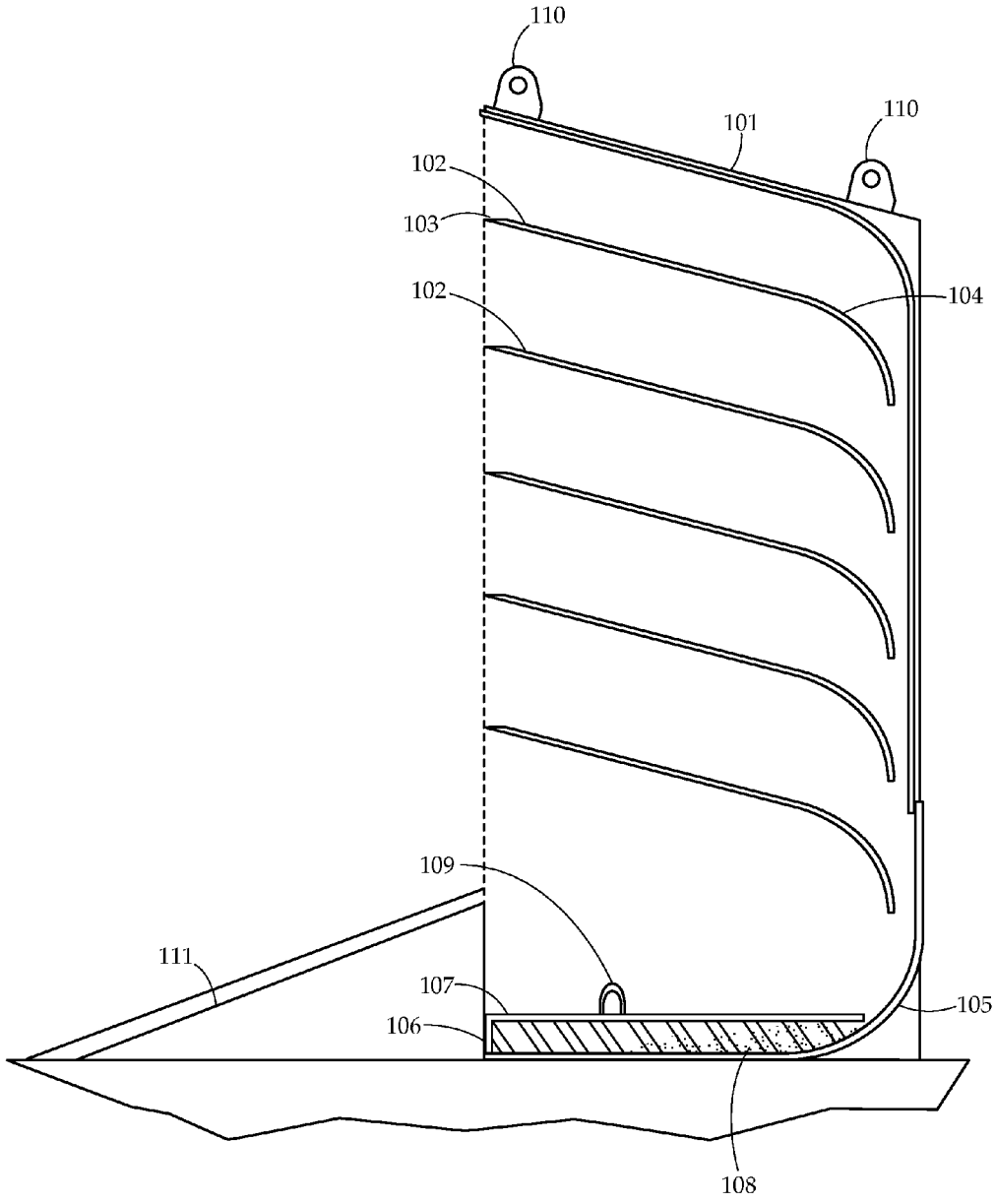
FIG. 1 provides a side cutaway view of an embodiment of the bullet trap.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Bullet traps are essential for enclosed firing ranges to contain fired bullets. Current bullet traps have several shortcomings including releasing significant quantities of lead dust into the nearby atmosphere, and being difficult to assemble and maintain.

The bullet trap described herein achieves exceptionally high bullet recovery, resulting in a minimal release of lead dust. Independent testing has determined that greater than 98% of the bullet is saved. Moreover, the bullet trap described herein is designed to be modular. The modular structure allows the bullet trap to be easily shipped, sold, manufactured and repaired. Finally, the present invention achieves these results without the need for a complex, cumbersome and costly deceleration chamber or a fluid flow and dispersion system.

Generally, the present invention concerns a bullet trap designed for shooting ranges. The bullet trap may comprise a housing that provides the structure and support for the bullet trap, a bullet receptacle to catch and contain the bullets, and a plurality of ramps positioned within the housing.

The bullet trap may have a housing that forms the outer supporting structure of the bullet trap. The housing may have a top, bottom, rear, and two side walls. The top, bottom and two side walls may extend from the rear, forming an open front for the housing.

In one embodiment, the different sides (bottom, top, two sides and rear) of the housing may be slideably mounted together. In another embodiment, the different sides of the housing may be mechanically mounted together using screws, bolts, brackets, and the like. In yet another embodiment, the different sides of the housing may be welded together. In still another embodiment, the different sides of the housing may be bent portions of one larger sheet of metal.

The housing may be of any size and shape that may receive, withstand, and retain bullets that are fired into it. In one embodiment, the housing may be approximately 100 inches in height, 48 inches in depth, and 60 inches in width. In another embodiment, the housing may be approximately 91 inches in height, 42 inches in depth, and 72 inches in width.

In one embodiment, the top of the housing may be angled upward from the rear, making the housing taller at the front than at the rear. In another embodiment, a connection point between the top and the rear of the housing may be arced, such that the rear of the housing arcs forward and extends to the top.

In another embodiment, an arced section may be formed at a connection point between the rear and the bottom of the housing, such that a bullet traveling along the rear of the trap may be smoothly directed along the arc towards the bottom of the housing.

In this embodiment, the arced section of the housing is constructed such that it alters the course of the bullet by a total of approximately 70-90 degrees from a substantially vertical path. After this direction change, the bullet may be received in the bullet receptacle.

An edge protector may be attached to the leading edges of the top, bottom and the two side walls. The edge protector may direct a bullet into the trap as opposed to receiving the direct bullet impact. In one embodiment, the edge protector may form a wedge shape that provides an angled slope for directing a bullet inward towards the trap.

In one embodiment, the edge protector may be formed of a first plate connected to an inside of the housing and angled outward from the open front of the housing. The first plate is supported against deformation by a second plate positioned against a rear of the first plate, connected to an outside of the housing or a front facing surface of the housing.

The housing may be constructed of any material that may withstand repeated tangential bullet impacts without substantial damage or deformation. Materials of which the housing may be made of include metals such as steel, aluminum, stainless steel, titanium, and the like, ceramic composites, composite materials, and the like. In one embodiment, the housing material may be constructed of a smooth metal to allow smooth travel of the bullet and to avoid a tumbling motion by the bullet. In another embodiment, the housing may be constructed of AR 400 steel plate. In yet another embodiment, the housing may be constructed of AR 235 steel plate. In still another embodiment, the side walls of the housing may be AR 400 steel plate, and the ramps and rear may be AR 500 steel plate. The material chosen for the housing may vary depending on the type of incoming projectiles intended to be trapped. For example, a handgun bullet trap may be constructed of lighter grade material than a rifle bullet trap.

In one embodiment, the housing may have a height extender. The height extender may be positioned on the top of the housing, and may extend from the top of the housing at a shallow angle to extend the height of the bullet trap. In a further embodiment, the height extender may be rotatable, such that it may rotate to a height extending position and back to a non-extending position.

A bullet receptacle may be positioned on or under the bottom of the housing. The bullet receptacle may be filled with a bullet receiving material that may absorb any remaining energy of a bullet fired into the trap, and thereby secure the bullet. Further, the bullet receptacle may serve as a dust shield to prevent a release of dust from the bullet, or dust caused by a breakdown of the bullet receiving material. In one embodiment, the bullet receiving material may be a dense granular material. In another embodiment, the bullet receiving material may be sand. In yet another embodiment the bullet receiving material may be ground rubber. In still another embodiment, the bullet receiving material may be ballistics gel.

In one embodiment, the bullet receptacle may be a tray removably mounted within the bottom of the housing. A front wall and two side walls of the tray may extend upwards from a bottom of the tray forming a container. The tray container may be filled with the bullet receiving material. A handle may be attached to an outside of the tray to allow the tray to be moved in and out of the housing. Further, the front wall may be reinforced with a deflector plate to block any bullets that may not be initially caught in the bullet receiving material.

A plurality of ramps may be mounted within the housing. The ramps may extend substantially horizontally between the sidewalls of the housing, and may extend nearly to the back of the housing. The ramps may be fixedly secured within the housing, or may be removably attached within the housing.

The ramps may be constructed of any material that may withstand repeated bullet impacts without substantial damage or deformation. Materials of which the ramps may be made of include metals such as steel, stainless steel, aluminum, titanium, and the like, ceramic composites, composite reinforced metals, and the like. In one embodiment, the ramps may be constructed of AR400 steel plate. In another embodiment, the ramps may be constructed of AR500 steel plate. The material chosen for the housing may vary depending on the type of incoming projectiles intended to be trapped.

The ramps may be mounted within the housing in any orientation that may allow them to receive bullets, and direct them towards the bullet receptacle. In one embodiment, the ramps may be mounted at a shallow angle descending from the front towards the back. In a further embodiment, the ramps may be mounted at a downward angle of substantially between 17-20 degrees. In still a further embodiment, the ramps may be mounted at a downward angle of approximately 17.5 degrees.

In one embodiment, each of the plurality of ramps may have a sharpened leading edge. The sharpened leading edge may either deflect an incoming bullet into the bullet trap housing, or may cut the bullet into two pieces, directing both pieces into the bullet trap housing. In one embodiment, the sharpened leading edge may be removable to allow replacement with a sharper edge. In another embodiment, the edge may be sharpenable to maintain a sharp edge after one or a plurality of bullet impacts. In another embodiment, the sharpened leading edge may be a herder material than the remainder of the ramp such that the sharpened leading edge is better suited to receive a direct impact from a bullet, and cut it into two pieces.

In one embodiment, each of the plurality of ramps may have a flat central portion, and a downward sloping arced portion at its rear. The arced portion may allow an incoming bullet to be smoothly directed downward along the ramp, towards the bottom of the housing, and eventually directed to the bullet receptacle.

A transition between the flat central portion and the arced portion may be smooth to prevent any bouncing or tumbling of a bullet travelling along the ramp. In one embodiment, the ramp is made from a continuous plate of steel.

In a further embodiment, the flat portion and the arced portion are constructed such that they alter the course of the bullet by a total of approximately 75-90 degrees from its original substantially horizontal path.

In one embodiment, a top ramp may be integral with the top of the housing, in that the housing may form the top ramp. In another embodiment, a leading edge of the top ramp may be mounted flush to the top of the housing, and the ramp may extend at a downward angle from the top towards the rear.

In one embodiment, the ramps may form a gap between a rear of the ramp and the rear of the housing. The gap allows downwardly directed bullets received by upper trays to pass behind the lower trays, towards the bullet receptacle.

The plurality of ramps may be removably mounted within the housing. In one embodiment, the ramps may be slideably mounted within a plurality of channels formed into the side walls of the housing. In another embodiment, the ramps may be slideably mounted within channels protruding from side walls. In another embodiment, the ramps may be snap-fit into the housing. In yet another embodiment, the ramps may be screwed or bolted to the housing.

In another embodiment, the plurality of ramps may have L shaped brackets mounted to a top of the ramps. The L shaped brackets may be configured to fit over and against a mounting rod or bracket that may be attached to one or both of the side walls of the housing.

In a further embodiment, a series of backer bars may provide an overlap between the ramp and the edge of the housing to prevent a bullet or bullet fragment from escaping from the trap. In one embodiment, the backer bars are welded to an underside of the ramp. In another embodiment, the backer bars are formed into the two side walls. In still another embodiment, the backer bars may form a lap joint allowing the backer bar to fit into an indent formed in either the ramp or the side wall. In this embodiment, a substantially flush surface may be formed providing a smooth surface for a bullet.

In another embodiment, the plurality of ramps may be fixedly attached except for the lower-most ramp, which may be removably attached. Removable attachment of the lower-most ramp may facilitate the access, removal and/or maintenance of the bullet receptacle.

The bullet trap may have a forward-ramp to catch low bullets rising from the ground and towards the lower-most ramp within the housing. The forward-ramp may be positioned at an angle of approximately 17.5 degrees, and serves to direct bullets upward into the trap.

The bullet trap thus formed may be configured to be attached to another bullet trap forming a larger bullet trapping structure. The connections between the bullet traps may be achieved by placing the bullet traps side by side, on top of each other, or a combination thereof.

In one embodiment, a plurality of bullet traps may be joined together by a series of slideable brackets. In this embodiment, a first side of each bullet trap may comprise female brackets, and a second side may comprise male brackets. Therefore, a first side of a first bullet trap may slideably engage with a second side of a second bullet trap. A plurality of bullet traps may be attached in this manner.

In another embodiment, a plurality of bullet traps may be joined together by bolting, riveting, or other mechanical attachment.

In yet another embodiment, a plurality of bullet traps may be joined together by welding of adjoining faces.

In embodiments having a plurality of joined bullet traps, an edge protector may be formed as a sharp wedge centered between the walls of the joined housings. The edge protector thus formed may allow a bullet to be deflected into one housing or another. Further, in the event of a direct impact, the edge protector may split a bullet into two pieces, deflecting one piece into a first housing, and the other piece into the second housing. Therefore, in any bullet impact event, the edge protector may serve to direct a bullet into the bullet trap, preventing a bullet from ricocheting off one or a plurality of walls of the bullet trap.

In a further embodiment, the edge protector may serve to attach the plurality of bullet traps together.

One or a plurality of lifting lugs may be disposed on an outer face of the housing. The lifting lug may allow for simplified and efficient movement of the bullet trap. This efficient movement may be valuable in mobile shooting ranges, for replacement of worn bullet traps, and in construction of the bullet trap or combinations of bullet traps. The trap may be moved and placed by any device capable of lifting it, including cranes, bulldozers and other construction equipment, as well as helicopters, and similar aircraft. Further the bullet trap may be transported in an overseas container, or on a mobile cargo pallet, among other modes of transportation.

In one embodiment of the bullet trap in operation, a shooter may fire a bullet towards the bullet trap. Once the bullet reaches the bullet trap, it will enter the front of the housing until it contacts a ramp. Once the ramp is contacted, the bullet will travel along the ramp, or be slightly deflected, until it reaches a downwardly arced portion of the ramp. At the arced portion of the ramp, the bullet may be directed downward along the arced portion, leaving the ramp, and travelling along a rear wall of the housing. When the bullet reaches a lower rear portion of the housing, it encounters an arced section of the housing. The arced lower rear section of the housing then directs the bullet along the arc, changing the bullet direction by approximately 70-90 degrees. Thus after passing the arced portion of the ramp and the arced section of the housing, the bullet direction has changed by a total of approximately 180 degrees. After the lower rear arced portion, the bullet is directed towards a bullet receptacle, which catches and secures the bullet.

While the embodiments noted above refer to substantially horizontal downward sloping ramps with downward sloping arced portions, it should be understood that the present invention may operate equally well with horizontal upwardly sloping ramp elements, vertical sideward-angled ramps or ramps angled relative to the sidewalls and/or top of the housing.

Turning now to FIG. 1 a side cutaway view of an embodiment of the bullet trap is shown. The bullet trap has a housing 101 that provides an outer structure for the trap. A lifting lug 110 is attached to an outer surface of the housing 101. The lifting lug 110 may facilitate movement, maintenance, construction, or assembly of the bullet trap. A forward-ramp 111 is positioned between a floor and an entrance to the housing 101 at an angle of approximately 17.5 degrees.

A plurality of ramps 102 are horizontally disposed within the housing 101, being attached to each side wall (not shown)

of the housing 101. Each ramp 102 has a sharpened leading edge 103 that either directs bullets along one of the ramps 102, or cuts the bullet in two pieces, directing each along different ramps 102. Each ramp 102 has an arced portion 104. The arced portion 104 directs an incoming bullet downward and along a rear of the housing 101. The housing 101 has an arced section 105 at its bottom rear that extends along its length. The arced section 105 directs a bullet from a substantially vertical path to a substantially horizontal path. Once the bullet is directed by the arced section 105 of the housing 101, it is trapped in the bullet receptacle 106. The bullet receptacle 106 has a quantity of bullet receiving material 108, shown here as sand. A reinforced plate 107 prevents a bullet not caught by the bullet receiving material 108 from escaping the trap. The bullet receptacle 106 may be removable to allow cleaning, replacement of the bullet receiving material 108, or removal of fired bullets. A handle 109 is attached to an outside face of the bullet receptacle 106 to facilitate removal of the bullet receptacle 106 from the housing 101.

Figure 2:
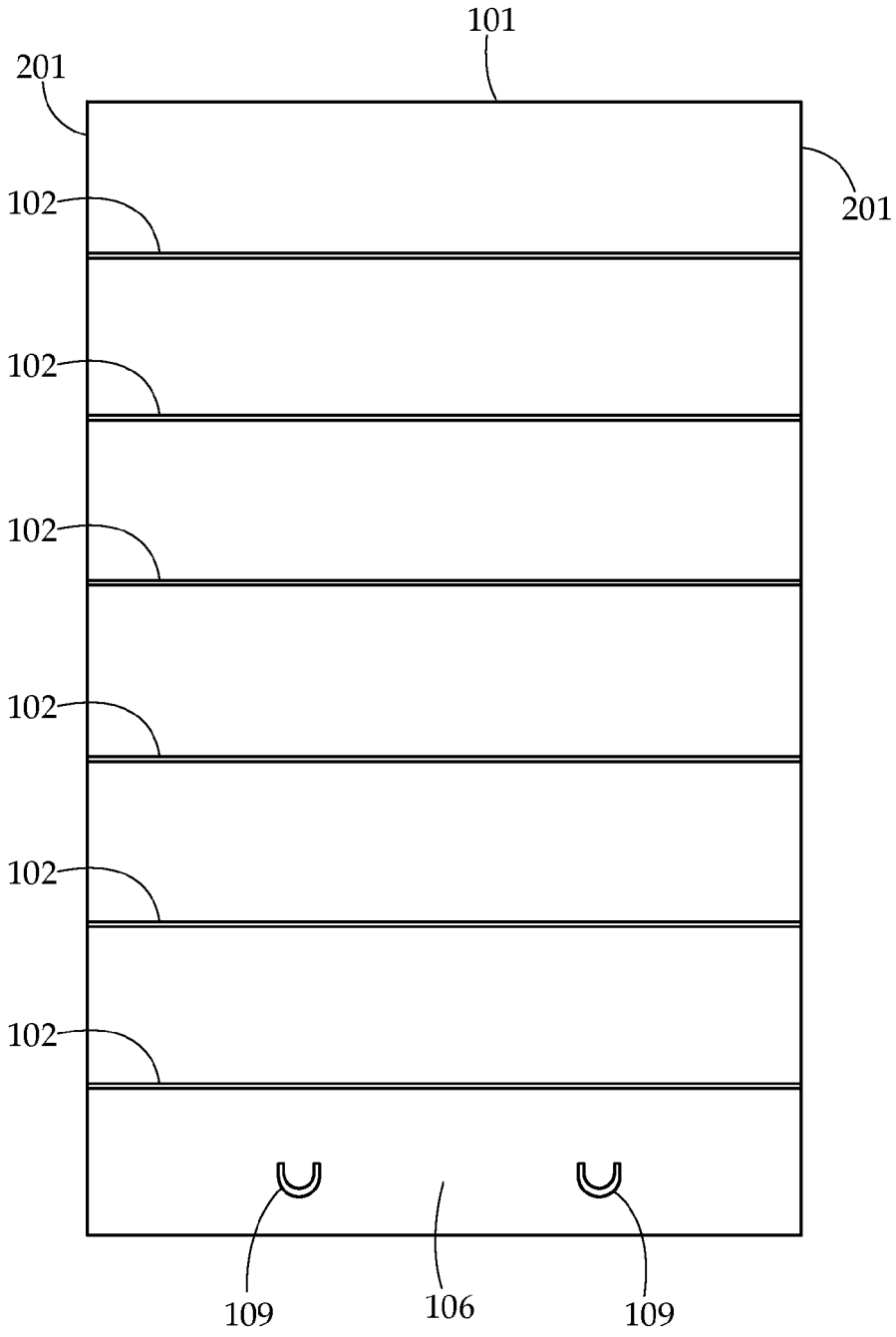
FIG. 2 provides a front view of an embodiment of the bullet trap.

FIG. 2 shows a front view of an embodiment of the bullet trap. The bullet trap has a housing 101 that forms its outer structure. Side walls 201 provide a left and right boundary to the bullet trap. A plurality of ramps 102 extend between each side wall 201, and act to guide the bullets into the trap. A bullet receptacle 106 is positioned at the bottom of the housing 101 to receive and retain bullets fired into the trap. A handle 109 is positioned on a top surface of the bullet receptacle 106 to allow the bullet receptacle 106 to be easily removed.

Figure 3:
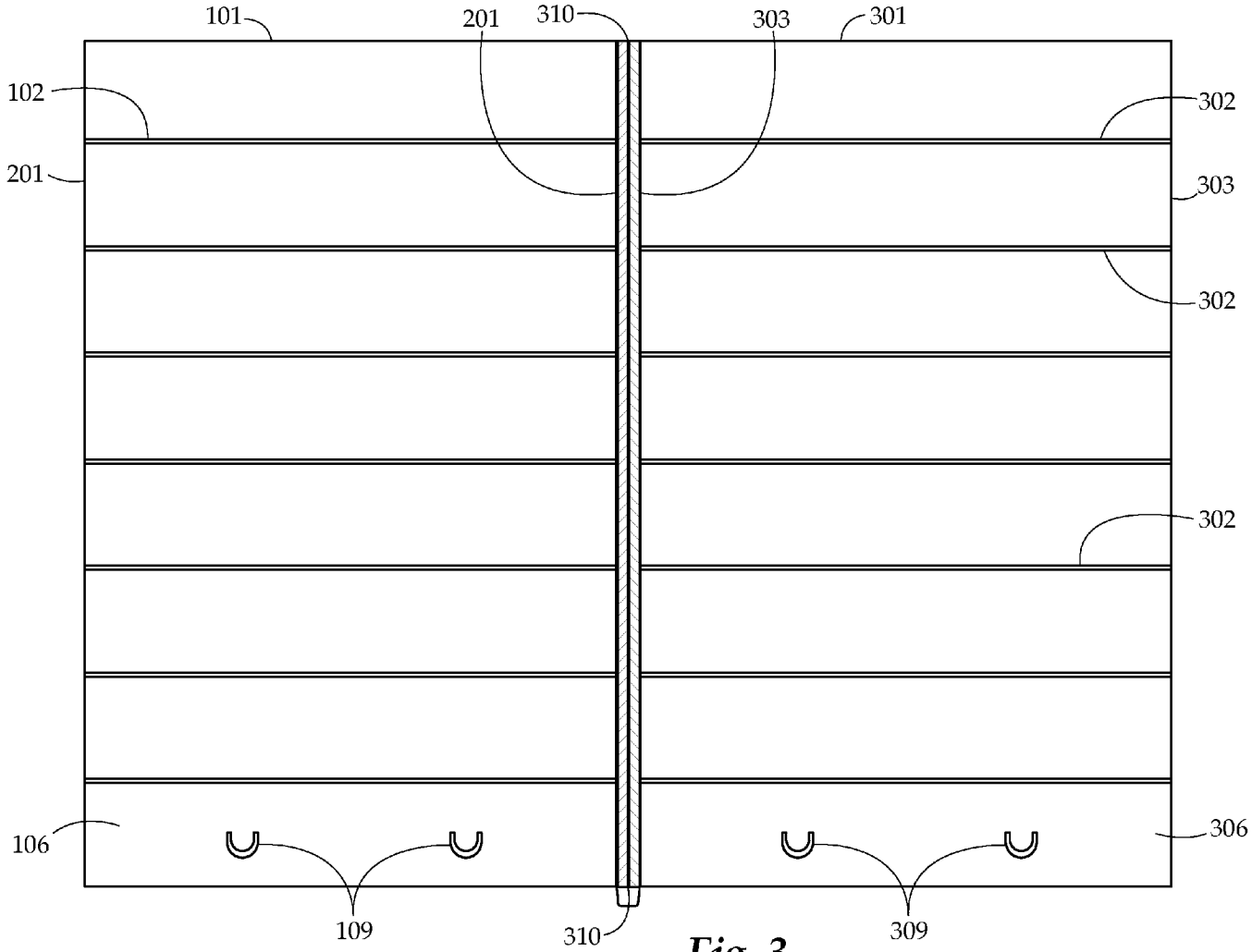
FIG. 3 provides a front view of an embodiment of two housings joined together to form a large bullet trap.

FIG. 3 shows a front view of an embodiment of two housings joined together to form a large bullet trap. A housing 101 forms the structure for one part of the bullet trap. Side walls 201 provide a left and right boundary to the housing 101. A plurality of ramps 102 extend between each side wall 201, and act to guide bullets into the trap. A bullet receptacle 106 is positioned at the bottom of the housing 101 to receive and retain bullets fired into the trap. A handle 109 is positioned on a top surface of the bullet receptacle 106 to allow the bullet receptacle 106 to be easily removed.

Connected to the housing is a second housing 301 which forms the structure for a second part of the bullet trap. Side walls 303 of the second housing provide a left and right boundary to the bullet trap. A plurality of ramps 302 extend between each side wall 303, and act to guide bullets into the trap. A bullet receptacle 306 is positioned at the bottom of the second housing 301 to receive and retain bullets fired into the trap. A handle 309 is positioned on a top surface of the bullet receptacle 306 to allow the bullet receptacle 306 to be easily removed.

The first housing 101 and second housing 301 are joined along side walls 201, 303. A wedge shaped edge protector 310 is disposed along the leading edge across this connection. The wedge shaped edge protector 310 directs a bullet that may hit it into one housing or the other, and in the event of a direct impact, may split the bullet in two and direct the pieces into both housings.

Figure 4:
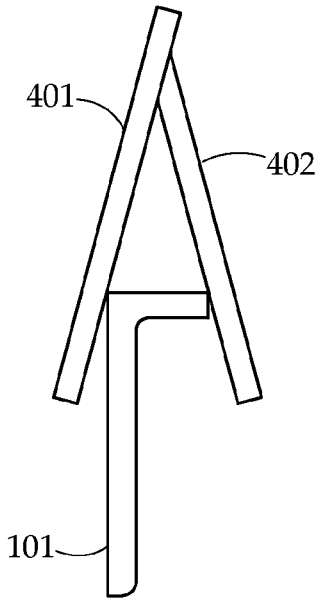
FIG. 4 provides a detail view of an embodiment of a leading edge of the housing.

FIG. 4 shows a detail view of an embodiment of a leading edge of the housing 101. The leading edge could be on the top or side wall of the housing 101. An edge protector 401 is angled inwardly towards the inside of the housing 101. The edge protector 401 acts to direct bullets inward to the bullet trap in the event that they hit the side wall or top of the housing 101. The edge protector 401 is supported by a support bar 402 to provide resiliency after numerous impacts.

Figure 5:
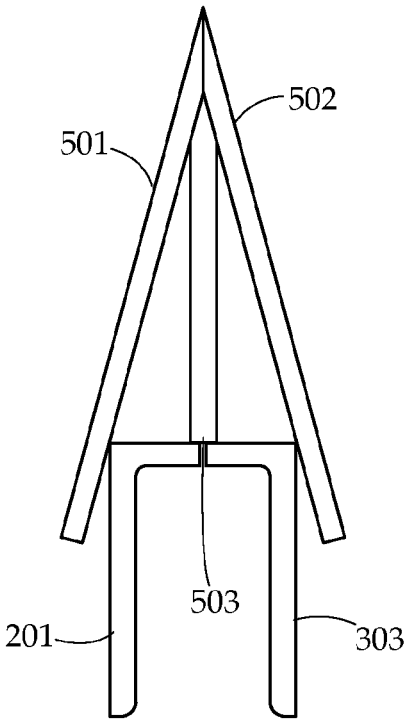
FIG. 5 provides a detail view of another embodiment of a leading edge of a housing when attached to a second housing.

FIG. 5 shows a detail view of another embodiment of a leading edge of a housing when attached to a second housing. In this view, a wedge shaped edge protector is positioned over each leading edge, covering both. A left edge protector 501 is mounted in front of the side wall 201 of the housing 101. The left edge protector 501 may direct bullets into the housing in the event of a bullet impact. A right edge protector 502 is mounted in front of the side wall 303 of the second housing. The right edge protector 502 may direct bullets into the second housing in the event of a bullet impact. The left edge protector 501 and right edge protector 502 form a sharp edge at their intersection. This edge serves to split a bullet into two pieces in the event of a direct impact, directing a first piece into one housing, and a second piece into the other housing. The left edge protector 501 and right edge protector 502 are supported by a column 503 which provides resiliency to the edge protectors after numerous bullet impacts.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A bullet trap comprising:

a housing having a bottom, a rear wall and two side walls;

a ramp extending substantially horizontally between the two side walls, the ramp being angled downward towards the rear wall of the housing, and constructed and arranged to direct a bullet fired from a firearm along a lower surface;

wherein the ramp has a sharpened leading edge, a substantially flat center portion, a downward arcing portion at a rear of the ramp and a smooth transition between the sharpened leading edge, the center portion, and the arcing portion;

an arced section formed in the housing along an intersection of the rear wall and the bottom of the housing;

a bullet receptacle at the bottom of the housing, positioned in front of the arced section;

wherein the bullet fired from the firearm is received within the bullet trap and contacts surfaces of the ramp, housing and arced section of the housing at angles of less than 20 degrees, the bullet having a direction of travel altered approximately 180 degrees from an angle of firing by travel along the ramp and the arced section of the housing, being finally received, while the bullet is travelling at approximately 180 degrees from an angle of firing, by a granular bullet receiving material within the bullet receptacle;

wherein the bullet receiving material is constructed and arranged to absorb a majority of a kinetic energy of the bullet while the bullet is travelling at approximately 180 degrees from the angle of firing; and the bullet trap being configured as a dry trap such that the housing, the ramp, and the bullet receptacle are dry when in operation.

2. The bullet trap of claim 1 wherein the quantity of bullet receiving material is sand.

3. The bullet trap of claim 1 wherein the ramp is angled downward towards the rear wall at an angle of substantially between 17-20 degrees.

4. The bullet trap of claim 1 wherein the ramp is angled downward towards the rear wall at an angle of 17.5 degrees.

5. The bullet trap of claim 1 further comprising an edge protector disposed on a leading edge of each of the two side walls, the edge protector being angled inwardly towards an inside of the bullet trap, and constructed and arranged to direct a bullet inward to the bullet trap.

6. The bullet trap of claim 1 further comprising a plurality of ramps.

7. The bullet trap of claim 6 wherein each of the plurality of ramps extends towards the rear wall of the housing, ending before reaching the rear wall of the housing, thereby forming a gap between the plurality of ramps and the housing.

8. The bullet trap of claim 6 wherein at least one of the plurality of ramps is removably mounted within the housing.

9. The bullet trap of claim 8 wherein the bullet receptacle further comprises a handle on an outer face.

10. The bullet trap of claim 1 wherein the bullet receptacle is removable from the housing.

11. The bullet trap of claim 1 further comprising a lifting lug mounted on an outside of the housing, the lifting lug constructed and arranged to be air mobile by having a tensile strength sufficient to be air lifted by a helicopter, the lifting lug allowing the bullet trap to be installed and reinstalled at a plurality of different locations.

12. The bullet trap of claim 1 further comprising:

a second housing having a bottom, a rear wall and two side walls;

a ramp extending substantially horizontally between the two side walls of the second housing, the ramp being angled downward toward the rear wall of the second housing and constructed and arranged to direct a bullet fired from a firearm;

wherein the ramp has a sharpened leading edge, a substantially flat central portion, and a downward arcing portion at a rear of the ramp;

an arced section formed in the second housing along an intersection of the rear wall and the bottom of the second housing;

a bullet receptacle at the bottom of the second housing, positioned in front of the arced section;

a central edge protector disposed on leading edges of adjacent side walls of the housing and the second housing, the central edge protector being a wedge centered between the adjacent side walls such that a bullet is directed into the housing or the second housing in an indirect impact, and is split in two pieces and directed into both the housing and the second housing; and the second housing being attached to the housing, thereby forming a larger bullet trap.

13. The bullet trap of claim 1 wherein the ramp flat portion and downward arcing portion alters a course of a substantially horizontally travelling bullet by approximately 75-90 degrees.

14. The bullet trap of claim 12 wherein the arced section of the housing alters the course of a substantially vertically travelling bullet approximately 70-90 degrees.

15. The bullet trap of claim 1 wherein 98% of a bullet is maintained after being fired into the bullet trap.

16. A bullet trap for securing bullets and minimizing lead dust comprising:

a housing having a bottom, a rear wall and two side walls;

a plurality of ramps extending substantially horizontally between the two side walls, the plurality of ramps are constructed and arranged to direct a bullet fired from a firearm along a lower surface;

wherein the plurality of ramps are angled downward towards the rear wall of the housing at an angle substantially between 17-20 degrees to allow a smooth travel of the bullet along the plurality of ramps;

wherein the plurality of ramps each have a sharpened leading edge, a substantially flat center portion, and a downward arcing portion at a rear of the ramp and a smooth transition between the sharpened leading edge, the center portion, and the arcing portion, each of the plurality of ramps allowing the smooth travel of the bullet along the plurality of ramps;

an arced section formed in the housing along an intersection of the rear wall and the bottom of the housing;

a bullet receptacle at the bottom of the housing, positioned in front of the arced section, constructed and arranged to secure the bullet fired from the firearm;

a quantity of granular bullet receiving material positioned within the bullet receptacle;

an edge protector disposed on a leading edge of the two side walls, the edge protector being angled inwardly towards an inside of the housing, and constructed and arranged to direct a bullet inward to the bullet trap;

wherein each of the flat portion and downward arcing portion of the plurality of ramps alters a course of a horizontally travelling bullet by approximately 80-90 degrees;

wherein the arced section of the housing alters the course of a substantially vertically travelling bullet by approximately 70-90 degrees;

wherein the bullet fired from the firearm is received within the bullet trap and contacts surfaces of one of the plurality of ramps, housing and arced section of the housing at angles of less than 20 degrees, the bullet having a direction of travel altered approximately 180 degrees from an angle of firing by travel along the ramp and the arced section of the housing, being finally received, while the bullet is travelling at approximately 180 degrees from an angle of firing, by the granular bullet receiving material within the bullet receptacle;

wherein the bullet receiving material is constructed and arranged to absorb a majority of a kinetic energy of the bullet while the bullet is travelling at approximately 180 degrees from the angle of firing; and the bullet trap being configured as a dry trap such that the housing, the plurality of ramps, and the bullet receptacle are dry when in operation.

17. The bullet trap for securing bullets and minimizing lead dust of claim 16 wherein each of the plurality of ramps extends towards the rear of the housing, ending before reaching the rear wall of the housing, forming a gap between the ramps and the rear wall of the housing.

18. The bullet trap for securing bullets and minimizing lead dust of claim 16:

wherein at least one of the plurality of ramps is slideably mounted within the housing; and further comprising a lifting lug mounted on an outside of the housing, the lifting lug constructed and arranged to be air mobile by having a tensile strength sufficient to be air lifted by a helicopter, the lifting lug allowing the bullet trap to be installed and reinstalled at a plurality of different locations.

19. A bullet trap for securing bullets and minimizing lead dust by maintaining at least 98% of a bullet fired into the bullet trap comprising:

a housing having a bottom, a rear wall and two side walls;

a plurality of ramps extending substantially horizontally between the two side walls, the plurality of ramps constructed and arranged to direct a bullet fired from a firearm;

wherein the plurality of ramps are angled downward towards the rear wall of the housing at an angle substantially between 17-20 degrees to allow a smooth travel of the bullet along the plurality of ramps and preventing a breakdown of the bullet;

wherein the plurality of ramps each have a sharpened leading edge, a substantially flat center portion, a downward arcing portion at a rear of the ramp, and a smooth transition between each portion, to allow the smooth travel of the bullet along the plurality of ramps and preventing a breakdown of the bullet;

an arced section formed in the housing along an intersection of the rear wall and the bottom of the housing;

a bullet receptacle at the bottom of the housing, positioned in front of the arced section, constructed and arranged to preserve and secure at least 98% of the bullet fired from the firearm;

a quantity of granular bullet receiving material positioned within the bullet receptacle;

an edge protector disposed on a leading edge of the two side walls, the edge protector being angled inwardly towards an inside of the housing, and constructed and arranged to direct a bullet inward to the bullet trap;

wherein each of the flat portion and downward arcing portion of the plurality of ramps alters a course of a horizontally travelling bullet by approximately 80-90 degrees; and wherein the arced section of the housing alters the course of a substantially vertically travelling bullet by approximately 70-90 degrees;

wherein the bullet fired from the firearm is received within the bullet trap and contacts surfaces of one of the plurality of ramps, housing and arced section of the housing at angles of less than 20 degrees, the bullet having a direction of travel altered approximately 180 degrees from an angle of firing by travel along the ramp and the arced section of the housing, being finally received, while the bullet is travelling at approximately 180 degrees from an angle of firing, by the granular bullet receiving material within the bullet receptacle;

wherein the bullet receiving material is constructed and arranged to absorb a majority of a kinetic energy of the bullet while the bullet is travelling at approximately 180 degrees from the angle of firing; and the bullet trap being configured as a dry trap such that the housing, the plurality of ramps, and the bullet receptacle are dry when in operation.

20. The bullet trap of claim 1 wherein the ramp and the housing are constructed of materials capable of withstanding a plurality of bullets fired from an automatic weapon.

* * * * *